United States Patent [19]

Wolf

[11] 4,213,028

[45] Jul. 15, 1980

[54] ELECTRIC HEATING DEVICE FOR VEHICLE WINDOWS

[76] Inventor: Arend Wolf, Wijverweg 1, Wassenaar, Netherlands

[21] Appl. No.: 887,390

[22] Filed: Mar. 16, 1978

[30] Foreign Application Priority Data

Mar. 26, 1977 [GB] United Kingdom ..... 12850/77

[51] Int. Cl.[2] ..... H05B 3/06; H01C 1/012; E06B 7/12

[52] U.S. Cl. ..... 219/203; 29/611; 29/621; 52/171; 174/117 A; 174/117 FF; 219/536; 219/541; 219/542; 219/543; 338/314; 338/328

[58] Field of Search ..... 219/203, 213, 219, 522, 219/543, 547, 345, 464, 467, 536, 542, 541, 552, 553; 174/117 A, 117 FF; 338/306, 307, 308, 311, 314, 328, 293; 52/171; 29/611, 620, 621

[56] References Cited

U.S. PATENT DOCUMENTS

| | | | |
|---|---|---|---|
| 3,266,661 | 8/1966 | Dates | 29/611 |
| 3,636,311 | 1/1972 | Steger | 219/522 |
| 3,736,404 | 5/1973 | Eisler | 219/203 |
| 3,757,087 | 9/1973 | Bernard | 52/171 |
| 3,918,783 | 11/1975 | Durocher et al. | 219/203 X |
| 3,928,748 | 12/1975 | Sauer | 219/203 X |
| 4,065,848 | 1/1978 | Dery | 219/203 |

FOREIGN PATENT DOCUMENTS

| | | | |
|---|---|---|---|
| 1487551 | 10/1977 | United Kingdom | 219/203 |

*Primary Examiner*—A. Bartis

*Attorney, Agent, or Firm*—Allison C. Collard; Thomas M. Galgano

[57] ABSTRACT

A heating device for heating a glass surface, such as the rear window of a car, includes a pair of elongated electrically non-conductive carrier strips having an adhesive layer on both sides thereof and secured in spaced-apart relationship to the glass surface by one of their adhesive layers to laterally delimit the surface area of the glass encompassed by the heating device. A plurality of spaced, thin electrically conductive foil strips, each cut in predetermined lengths from a continuous strip, and each of which has an adhesive layer on one side, extend between the carrier strips. The ends of the foil strips overlie the carrier strips and are secured to the carrier strips and the glass surface by the adhesive layer thereof. A strip-shaped electrical terminal conductor overlies each carrier strip in electrically conductive engagement with the foil strip ends and is fastened to the carrier strip by the other adhesive layer on the carrier strip exposed between the foil strip ends. The device is also adapted to be used as a frame antenna.

10 Claims, 4 Drawing Figures

ELECTRIC HEATING DEVICE FOR VEHICLE WINDOWS

This invention relates to a heating device for a glass surface or the like. More particularly, it relates to such a heating device consisting of a lattice of foil strips provided with adhesive surfaces, the strips being of a material which conducts electricity, and having terminals for connection to a source of direct current.

From British Patent Specification No. 1,355,491 there is already known an electric heating device for a window, e.g. of a car. This heating device consists of a lattice-like structure of foil which conducts electricity, the foil having on one side an adhesive layer to attach it onto the window pane.

This known heating apparatus requires the stamping out of considerable areas from a sheet of foil and the amount of waste connected with this is large. Moreover, it is necessary to attach the heating device structure provisionally to a covering foil until it is applied to the window, in order that it will not be damaged, as it is relatively delicate. This construction and the ancilliaries connected with it, including the stamping machine, make the heating device relatively expensive.

Moreover, the application to the window pane necessitates a certain skill. Finally, one is limited to the sizes of heating device offered, which for reasons of practicality are restricted to a few standard sizes.

An object of the present invention is to create an electric heating device of this kind, which consists of the simplest parts and may be manufactured at an extremely favorable price.

A further object lies in providing for the construction in such a way that without a great increase in expenditure the possibility is created of manufacturing heating devices as large as required and thereby suiting the particular circumstances, in particular, the size of the windows.

According to the invention, this is achieved by the provision of two carrier strips which provide for lateral delimitation and for the attachment of the heating device to a glass surface, made of foil of an electrically nonconductive material with a layer of adhesive on both sides, an arbitrarily divisible supply of thin electrically conductive foil strips, provided with an adhesive layer on one side, and two strip-shaped electric conductors attachable to the carrier strips of which at least one is provided with electric terminals for connection to a source of direct current.

This design makes it possible to attach a heating device of any size to a window pane in a 'do-it-yourself' operation with the distances of the electric conductors, and thereby the heating effect not being predetermined. The necessary individual parts can be supplied to the user in a convenient form e.g. as foil rolls, so that also the necessary packaging and the storage costs can be kept very small.

The device according to the invention makes it possible also to equip replacement panes, which have no built in heating device in the form of electric conductors in the glass, subsequently with a heating device.

The invention moreover concerns a method of applying a heating device to a glass surface or the like and is characterized by the fact that, as lateral delimitation of the device, two carrier strips of electrically non-conductive material, provided with an adhesive layer on both sides, in parallel spacing relative to one another, are secured onto the glass surface to be heated. A number of foil strips, provided with an adhesive layer on one side and being electrically conductive, drawn from a strip supply and out to the required length, are secured on the pane of glass, such that the ends thereof are attached to opposite carrier strips. Over these ends of the foil strips, and along each of the carrier strips, an electrical conductor is laid and fastened firmly on the adhesive surfaces of the carrier strips to be found exposed between the foil strips. This electrical conductor is connected to a supply of electric current.

Other objects and features of the present invention will become apparent from the following detailed description when taken in connection with the accompanying drawing which discloses a single embodiment of the invention. It is to be understood that the drawing is designed for the purpose of illustration only, and is not intended as a definition of the limits and scope of the invention disclosed.

In the drawing, wherein similar reference numerals denote similar elements throughout the several views.

Figure 1:
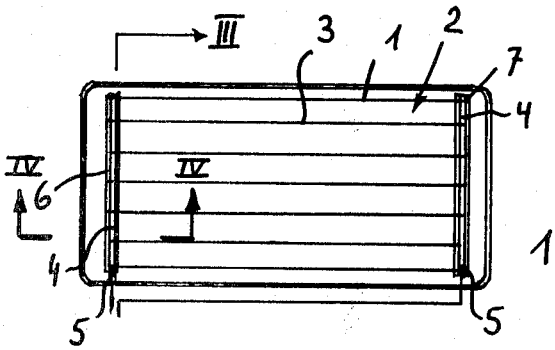
FIG. 1 is a front view of an installed heating device according to the invention.
Figure 4:
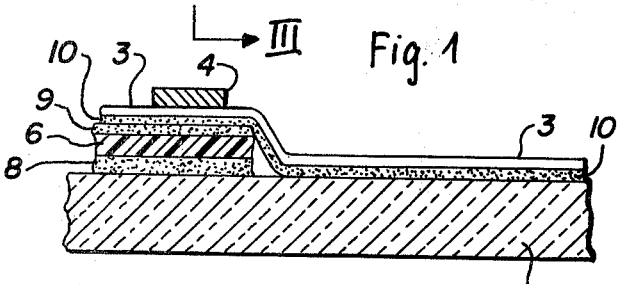
FIG. 4 is an enlarged, cross-sectional view through line IV—IV of FIG. 1.

Referring now in detail to the drawings, FIG. 1 shows a window pane 1, e.g. the rear window of a car with an electric heating device 2 embodying the present invention. This device 2 consists of a number of foil strips 3 arranged in parallel, with spaces between them, made of a material which conducts electricity. The ends of strips 3 are each connected to a strip-shaped electrical conductor 4, each of which bear an electric terminal 5. Terminal 5 may be connected in the usual manner (not shown), by a cable to a source of direct current, e.g. to a battery.

Figure 3:
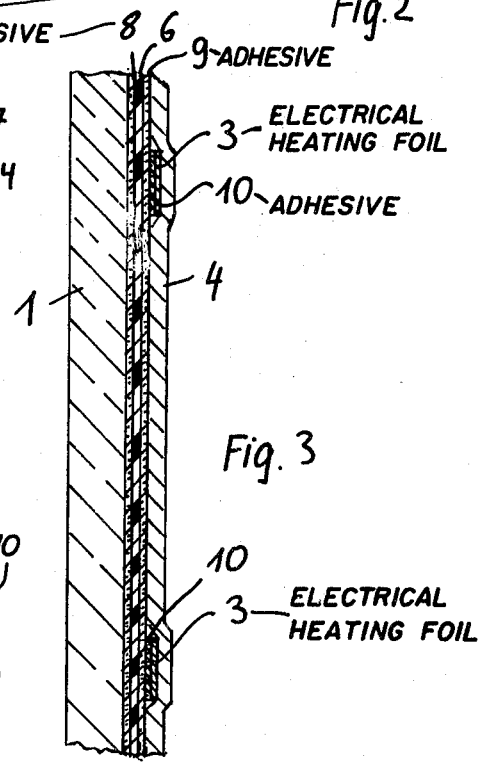
FIG. 3 is an enlarged cross-sectional view through line III—III of FIG. 1.

FIG. 3 shows to a magnified scale details of the construction of the heating device 2.

Figure 2:
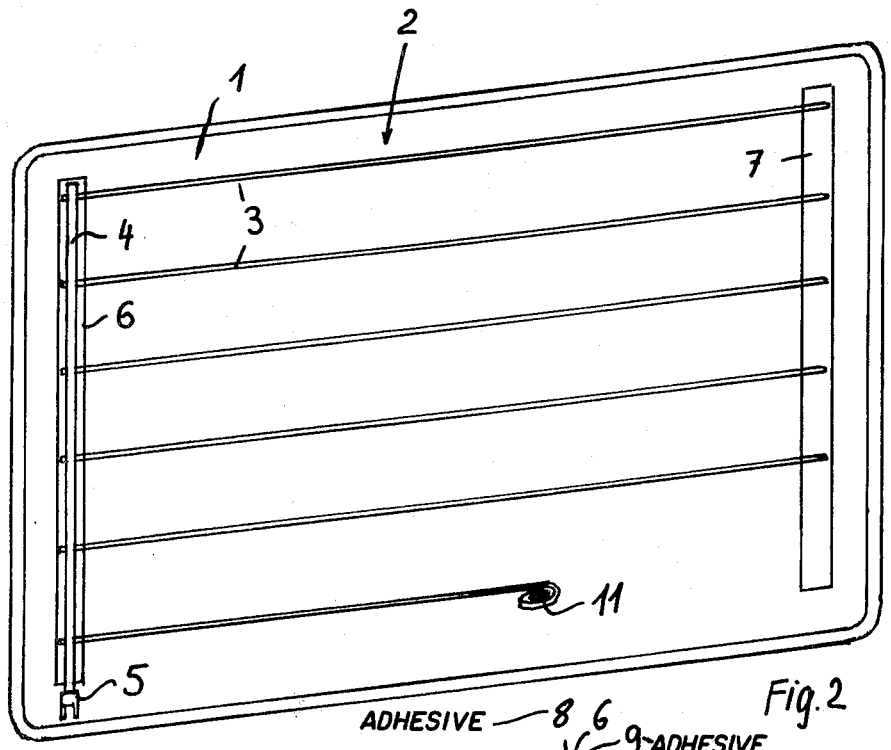
FIG. 2 is a perspective view of a window pane with such a heating device partially attached to it.

On the glass surface 1, as shown in FIG. 2, a vertical carrier strip 6,7 is situated on each side. Each carrier strip 6,7 possesses a self-adhesive upper and lower adhesive surface 8,9 and is attached to the glass surface by means of the lower adhesive surface 8 e.g. on the inner side of a car window. Carrier strips 6 and 7, for the purpose of transparency, are fabricated from a plastic foil (e.g. of polyvinyl-chloride or similar material) of an electrically-neutral material.

The horizontally arranged foil strips 3 consist of a material which conducts electricity e.g. light metal foil of about 0.2 mm thickness and carry on one side a self-adhesive coating 10. As FIG. 2 shows, foil strips 3 can be wound from a spool 11. In some cases, the adhesive layer 10 can also be covered by a covering foil (not shown) in the familiar way until it is used.

Foil strips 3 are cut to the required length and are adhesively applied on the glass surface 1 from one carrier strip 6 to the other carrier strip 7, as well as on the carrier strips 6 and 7 themselves.

In addition, over the ends of these foil strips, and in alignment with the carrier strips 6 and 7, strip-shaped electrical conductors 4 are adhesively applied onto carrier strips 6 and 7. These electrical conductors 4 consists of a foil which conducts electricity (e.g., of a light metal with a thickness of about 0,2 mm and possess no adhesive surface of their own). In this way, at the points where the electrical conductors 4 and the foil strips 3 meet, one achieves a connection which conducts electricity. Electric terminals 5 are fastened to the electrical conductors 4. These may be connected in one piece or in any other suitable way e.g. by means of a bolt fastened to it, such that it conducts electricity.

FIG. 2 shows the electric heating device 2 during installation. A number of foil strips 3, out to a certain length, are already secured to glass surface 1 and are attached to carrier strips 6 and 7. Also on the left carrier strip 6, an electrical conductor 4 is already fitted. The upper adhesive surface 9 of electrical carrier strips 6 and 7 in the spaces between the individual foil strips 3 serving to fasten conductor 4 to strips 6 and 7.

In general, the electrical conductors 6 and 7 can be five or twelve times as thick as the foil strips 3 which conduct electricity.

Instead of heating the glass pane, the device consisting of foil strips 3 and electrical conductors 6 and 7 can also be employed as a frame antenna.

Thus, while only a single embodiment of the present invention has been shown and described, it will be obvious to those persons of ordinary skill in the art that many changes and modifications may be made thereunto without departing from the spirit and scope of the invention.

What is claimed is:

1. In a heating device for a glass surface or the like, of the type including a lattice arrangement of laterally-spaced electrically-conductive foil strips electrically connected in parallel at their ends by transversely-extending electrical terminals for coupling the strips to a source of direct current, the improvement comprising:

two elongated carrier strips each made of an electrically non-conductive material and having an adhesive layer on both sides thereof, said strips being securable to the glass surface by means of one of their adhesive layers in spaced-apart, generally parallel relationship so as to laterally delimit the surface area of the glass encompassed by the heating device;

said foil strips comprising a plurality of thin, electrically conductive, foil strips, cut from an arbitrarily divisible continuous strip supply, each of which has an adhesive layer on one side, said strips extending between and disposed generally normally to, said carrier strips and being secured to said carrier strips and the surface of the glass therebetween in spaced apart relationship by means of said adhesive layer thereof, the ends of each foil strip overlying said carrier strips; and said terminals comprise two strip-shaped electrical conductors, one of said conductors being fastened onto a respective one of said carrier strips by the other adhesive layer on the carrier strip exposed between said foil strip ends, said conductors overlaying the ends of each of said foil strips and being in electrically conductive engagement therewith.

2. The device according to claim 1, wherein said adhesive layers of said carrier strips and said electricity-conducting foil strips each comprise a self-adhesive layer.

3. The device according to claim 1, wherein said electrically-conductive foil strips comprise a thin metal layer.

4. The device according to claim 1, wherein said strip-shaped electrical conductors are about five to twelve times as thick as said electrically-conductive foil strips.

5. The device according to claim 1, wherein said strip shaped electrical conductors ave a thickness of about 0.2 mm.

6. The device according to claim 1, wherein said carrier strips are made of transparent plastic.

7. The device according to claim 1, wherein said device is adapted to be used as an aerial.

8. A method of mounting a heating device on a glass surface or the like, comprising the steps of:

securing two electrically non-conductive carrier strips, each of which is provided with an adhesive layer on both sides to the glass surface in spaced-apart, generally parallel relationship to one another by means of one of their adhesive layers;

cutting a plurality of electrically conductive foil strips, having an adhesive layer on one side thereof, from a continuous strip supply thereof, said strip being cut to a predetermined length generally equivalent to the distance between said carrier strips;

securing the ends of said foil strips by means of their adhesive layers in overlying relation to said carrier strips, and the remainder of said foil strips by means of their adhesive layer to the surface of the glass between said carrier strips such that said foil strips are disposed generally normal to said carrier strips in spaced-apart relationship;

securing a strip-shaped electrical conductor to each of said carrier strips by means of the other adhesive layer of said carrier strip exposed between the ends of the foil strips overlying the carrier strip, such that said strip-shaped conductors overlie the ends of each of said foil strips in electrically conductive engagement therewith and adhere to the exposed other adhesive layer of said carrier strips between said foil strips; and coupling one end of at least one of said conductors to a source of direct current.

9. The method according to claim 8, wherein said foil strips are arbitrarily spaced from one another.

10. The method according to claim 8, wherein said foil strips are formed with a length larger than that of said carrier strips.

* * * * *